United States Patent [19]

Walther et al.

[11] Patent Number: 4,467,738

[45] Date of Patent: Aug. 28, 1984

[54] DETACHABLE DRIVE FOR SEWING MACHINE TRIMMING KNIFE

[75] Inventors: Karl-Heinz Walther; Kurt Vollmar, both of Weilerbach; Albert Dusch, Kaiserslautern, all of Fed. Rep. of Germany

[73] Assignee: Pfaff Industriemaschinen GmbH, Fed. Rep. of Germany

[21] Appl. No.: 435,498

[22] Filed: Oct. 20, 1982

[30] Foreign Application Priority Data

Nov. 12, 1981 [DE] Fed. Rep. of Germany ..... 3144966

[51] Int. Cl.[3] ..... D05B 37/04

[52] U.S. Cl. ..... 112/129

[58] Field of Search ..... 112/122, 123 R, 125, 112/129, 130, 321

[56] References Cited

U.S. PATENT DOCUMENTS 3,980,031 9/1976 Landwehr ..... 112/122

4,384,540 5/1983 Vollmar et al. ..... 112/129

FOREIGN PATENT DOCUMENTS 2357605 5/1975 Fed. Rep. of Germany ..... 112/129

*Primary Examiner*—Werner H. Schroeder

*Assistant Examiner*—Andrew M. Falik

*Attorney, Agent, or Firm*—McGlew and Tuttle

[57] ABSTRACT

A sewing machine comprises a rotatable main shaft which drives a needle upwardly and downwardly over a sewing station to sew through material which is moved thereover and which includes a trimming knife mounted adjacent the needle for upward and downward movement for selectively and periodically cutting the material. The trimming knife is driven by a linkage mechanism from an eccentric drive and the eccentric drive is detachably connected between the main shaft and the linkage mechanism and permits the knife to be driven with the mainshaft of the sewing machine or by an independent drive through a separate detachable drive mechanism. In one embodiment a positioning motor is connected to the drive through a hand wheel and an engageable and disengageable clutch so that it may drive a linkage mechanism including an eccentric to move the knife upwardly and downwardly for cutting the material being sewn during the operation of the sewing machine or separately when the sewing machine drive is discontinued. The drive is defined from the positioning motor to the hand wheel and through a clutch to the main shaft of the sewing machine which drives an eccentric for operating the linkage mechanism to reciprocate the knife. Another embodiment includes a separate trimming drive including two free wheel clutch arrangements permitting the knife to be driven synchronously with the sewing machine needle drive as well as its separate drive.

10 Claims, 4 Drawing Figures

79
78
71
117
115
116
114
112
111
113
110
108
107
115
109
101
100
98
77
99
97
115
96
103
102
95
92
91
93
94
106
105
104
90
72
80
75
82
70
81
83
85
84
86
76
87
89
73
74
88
74

DETACHABLE DRIVE FOR SEWING MACHINE TRIMMING KNIFE

FIELD AND BACKGROUND OF THE INVENTION

This invention relates in general to sewing machines and in particular to a new and useful machine with a trimming device for the sewing material having a trimming knife which is in operative connection with a separate drive connected with the main shaft.

A sewing machine with a trimming device is known from German Pat. No. 23 57 605. The trimming device of the sewing machine has a two-arm swing lever whose one arm is connected over an eccentric bar with an eccentric secured on the arm shaft, and whose other arm is connected over a transmission element secured thereon and a guide rod with a vertically guided trimming knife. In the transmission element, which is in the range of the axis of rotation of the swing lever, the trimming knife is raised into rest position. But when the transmission element is at the end of the swing lever, the trimming knife is lowered into operating position, and thus into the range of a counterknife. In this position, a bolt, which connects two tie rods articulated on the transmission element with a swivelling coupling part, locks into a recess an entrainer part which is secured at one end of a connecting rod. The other end of the connecting rod bears on an electromagnetically releasable ratchet. Behind the ratchet is arranged a wobble plate which is driven by a separate motor.

When the trimming device acts during the sewing, the trimming knife driven by the eccentric and the needle work in synchronism. In order to prevent the timming knife from being in the way when the workpiece advances, the eccentric is so designed that it moves the trimming knife downward only during the feeding intervals of the workpiece to carry out a trimming stroke.

In order to trim the edge of the workpiece in the corner range during the rotation of the workpiece about the needle axis when the sewing machine stands still, the ratchet is unlocked and at the same time the separate motor is started so that the connecting rod pressed by spring force onto the rotating wobble plate is set into a reciprocating motion. This motion is transmitted directly to the transmission element so that the trimming knife moves up and down. But the edge of the workpiece is only trimmed when the sewing machine has first been stopped with the eccentric in a trimming position. The arm carrying the swing lever is therefore in its lower swivel position, and the trimming knife moves up and down in the range of the counterknife. In order to be able to turn the workpiece properly in the corner region the needle must be in its bottom position with the sewing machine standing still, so that it can act as an axis of rotation during the rotation of the workpiece.

But these different prerequisites for trimming, with the sewing machine running and standing still, can only be met if the known trimming device on a sewing machine is used with a bottom transport, because only in this type of sewing machine is the needle in its bottom position during the feeding interval of the workpiece, and the eccentric of the trimming device is necessarily in a trimming position with the sewing machine stopped in the bottom position of the needle.

But the known trimming device can not be used for sewing machines with bottom and needle transport, because in this type of sewing machine, the needle serving, among other things, as a feeding means, is not in the bottom position during the feeding interval, but during the feeding movement of the workpiece. If one wanted to us the known trimming device on a sewing machine with under—and needle transport and effect the trimming in the corner region of a workpiece with the sewing machine standing still and the needle in bottom position, the eccentric of the trimming device would be turned by 180° relative to the position of sewing machines with a bottom transport alone, so that the trimming during the sewing would necessarily take place during the feeding movement of the workpiece. In this case the workpiece moving relative to the trimming knife would stall at the trimming knife and thus be moved out of the desired feeding direction.

SUMMARY OF THE INVENTION

The invention provides a trimming device which can be used both for sewing machines with bottom transport alone and for sewing machines with bottom and needle transport.

By designing the sewing machine so that the driving connection between the eccentric and the main shaft can be disengaged and the eccentric can then be driven independent of the main shaft, the trimming knife is driven over the eccentric not only during the trimming with the sewing machine running, but also during the trimming with the sewing machine standing still. Since in contrast to the known device no trimming can ever take place in this trimming device with the eccentric standing still, it can have no adverse effect that the eccentric in sewing machines with bottom and needle transport is not in the bottom, but in the trimming position with the needle raised. The trimming device according to the invention can therefore be used without restrictions both for sewing machines with bottom transport alone and for sewing machines with bottom and needle transport.

In one embodiment of the invention, the eccentric is in constant driving connection with the motor and is connected with the main shaft over a clutch. A single motor is required, which selectively drives the trimming device and over the clutch also the sewing machine, or with the clutch disengaged and the sewing machine thus standing still, the trimming device alone can thus be driven.

Another advantageous constructional design is also disclosed wherein, due to the use of a positioning motor, the eccentric of the trimming device is stopped at one end of a trimming operation, with the sewing machine disconnected, in the same position which it had been before the sewing machine was disconnected. This way the sewing machine can be readily coupled again with the positioning motor in the correct phase position, so that the proper phase tuning between the main shaft and the eccentric can be restored again for the next sewing operation. In order to maintain the phase tuning between the main shaft and the eccentric during sewing, it is advisable to design the clutch as a form-locking clutch.

In another embodiment of the invention, the eccentric is connected over a freewheel clutch with the main shaft of the sewing machine, as well as over a driving connection and another freewheel clutch with a motor that is independent of the sewing machine drive. In this case the eccentric of the trimming device is driven by the separate motor with the sewing machine standing still. The use of a separate motor also permits driving the trimming device with a relatively higher frequency when sewing at a lower speed. To this end the separate motor is started with the sewing machine running, which drives the eccentric over the associated freewheel clutch and the driving connection. The eccentric can here be driven faster in the direction of the main shaft carrying it than the main shaft. Since the eccentric is disconnected in this case from the main shaft over the disengaged idle freewheel clutch, there is no superposition of the driving movement of the separate motor and of the movement of the main shaft, so that the trimming knife is driven with the same trimming frequency, which depends solely on the speed of the separate motor.

To make sure that the eccentric can be brought again into the proper phase position regarding the main shaft at the end of a trimming operation carried out with the sewing machine standing still, and can be synchronized with it again, the driving connection is provided with entrainer elements arranged in equal intervals which cooperate with an adjusting device.

Accordingly it is an object of the invention to provide an improved sewing machine comprising a rotatable main shaft with a sewing station over which material to be sewn is moved and a needle which is driven by the main shaft to move upwardly and downwardly through the material along with a trimming knife which is mounted adjacent the needle and which is moved upwardly and downwardly by detachable drives which is connected between the mechanism for moving the trimming knife and the main shaft in a manner to permit drive of the cutting knife with the main shaft and independently thereof by the detachable drive.

A further object of the invention is to provide a sewing machine which is simple in design, rugged in construction and economical to manufacture.

For a better understanding of the invention, reference is made to the accompanying drawings and descriptive matter in which preferred embodiments of the invention are illustrated.

GENERAL DESCRIPTION OF THE PREFERRED EMBODIMENTS

Figure 1:
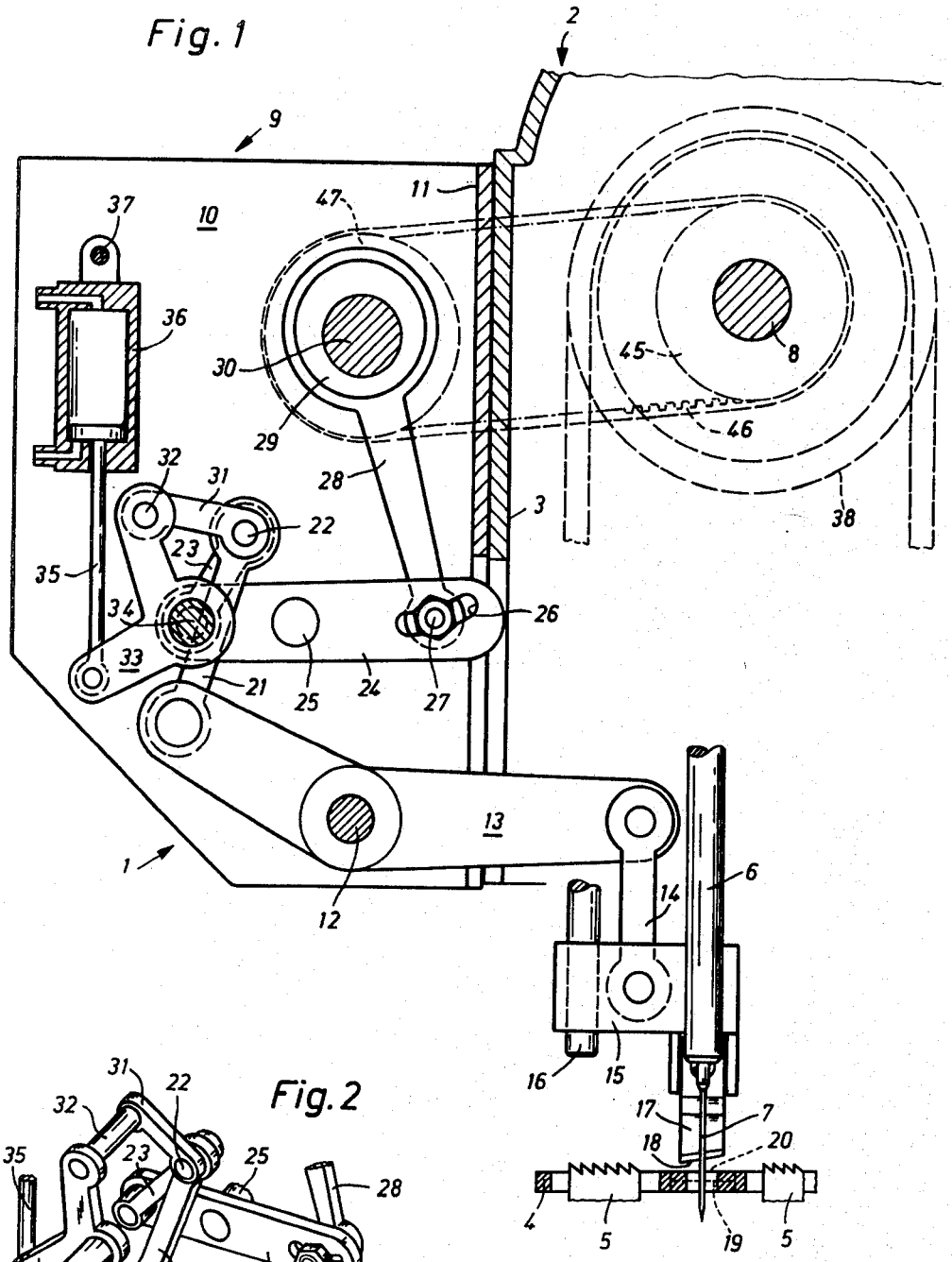
FIG. 1 is a partial sectional view of the sewing machine having a trimming device constructed in accordance with the invention.

Referring to the drawings in particular, the invention embodied therein in FIG. 1 comprises a sewing machine generally designated 2 having a trimming device 1 and including a main shaft 8 which is rotated by a main shaft drive motor (not shown) in order to reciprocate a needle 7 so that it moves through a slot of a stitch plate 4 to sew through the material which is moved thereover. The arrangement includes a trimming knife 17 which is mounted adjacent the sewing needle 7 for upward and downward movement to periodically and selectively cut the material. The connecting mechanism or link mechanism including a two-armed lever 13 is connected to the knife 17 to move it upwardly and downwardly by a detachable drive 29 which is connected between the mechanism including the two-armed lever 13 and the main shaft 8 and permits a drive of the knife with the main shaft 8 and selectively independently thereof by the detachable drive.

EXAMPLE 1

Figure 2:
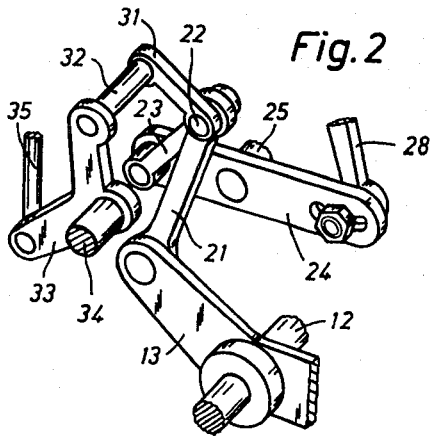
FIG. 2 is a partial perspective view of a linkage for driving a trimming device shown in FIG. 1.
Figure 3:
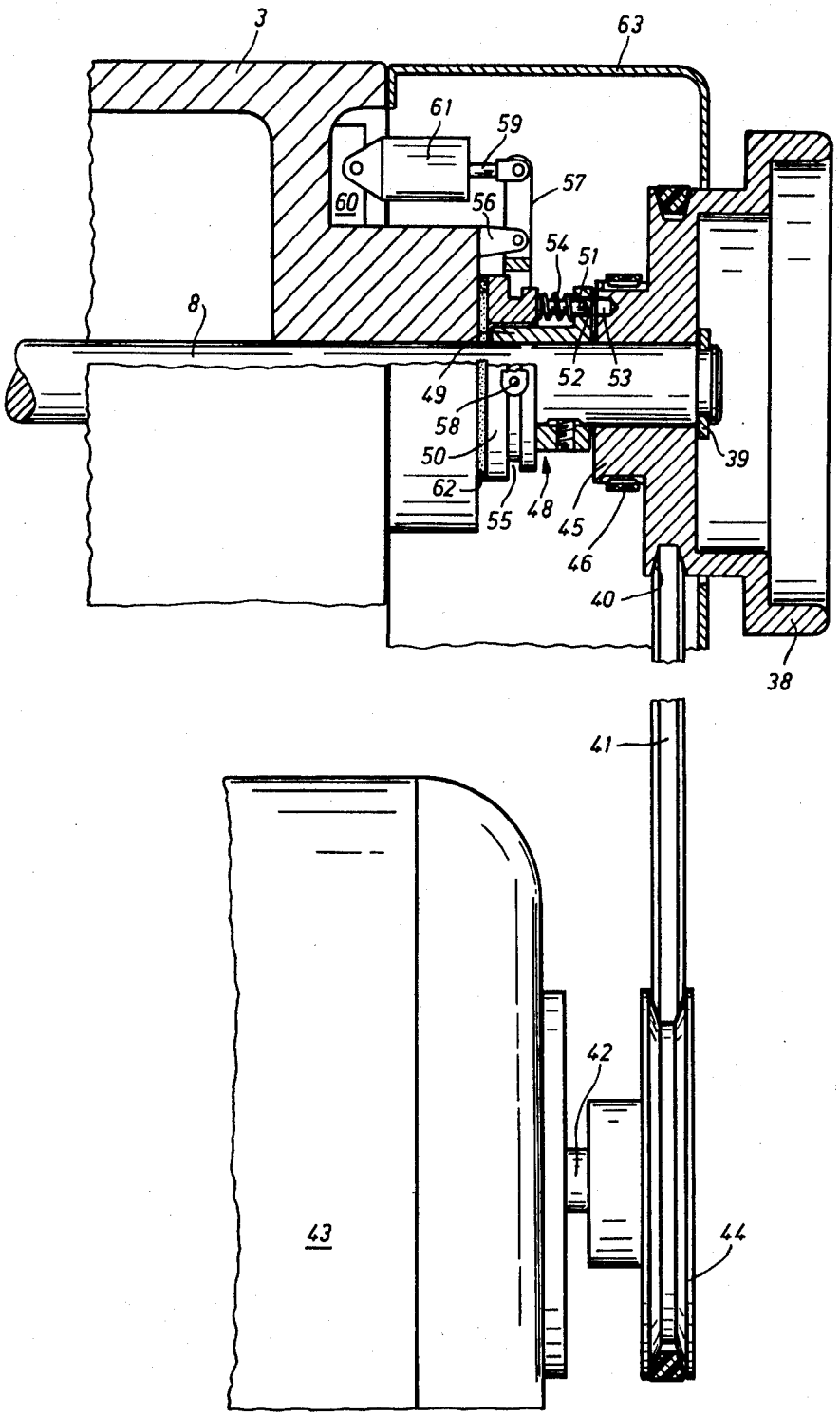
FIG. 3 is a partial side elevational and sectional view of the sewing machine showing the positioning motor and the hand wheel connection of the drive shaft.

A trimming device 1 represented in FIGS. 1 to 3 is arranged on a sewing machine 2, of which only a part of casing 3, a stitch at plate 4, a cloth feed 5 and a needle bar 6 with an inserted thread-carrying needle 7 are shown. Needle bar 6 is moved up and down by a main shaft 8 over a known gear (not shown) to form the seam and moves swingingly about a horizontal axis extending parallel to main shaft 8 to enhance the feeding movement of cloth feed 5 driven in known manner.

Trimming device 1 has a frame 9 of two parallel side plates 10 and a connecting plate 11 which is secured on casing 3 of sewing machine 2. On a bolt 12 secured in side plates 10 is pivotally mounted a two-armed lever 13, at one end of which is arranged a guide rod 14. Guide rod 14 is articulated with a carrier 15 which is arranged for up and down movement on a guide bar 16 secured on the sewing machine casing in a manner not shown here. On carrier 15 is secured a trimming knife 17 with a cutting edge 18. Associated with trimming knife 17 is a fixed counterknife 19, arranged in a recess (not shown) of stitch plate 4, which has a cutting edge 20. At the other end of lever 13 is arranged a guide rod 21, which is connected by a joint bolt 22 with another guide rod 23. Guide rod 23 is arranged at one end of a two-arm swing lever 24 which is pivotably mounted on a bolt 25 secured in one of the side plates 10. In an oblong slot 26 provided at the other end of swing lever 24 is adjustably mounted a joint bolt 27 on which is arranged an eccentric rod 28. Eccentric rod 28 embraces an eccentric 29 which is secured on a shaft 30 rotatably mounted in side plates 10.

A guide rod 31 pivots on joint bolt 22. The guide rod is arranged over a bolt 32 at one end of an L-shaped switching handle 33. Switching handle 33 is pivotally mounted on a bolt 34 which is secured in one of the side plates 10 of frame 9. The other end of switching handle 33 is connected with piston rod 35 of a compressed-air cylinder 36 which is arranged pivotally on frame 9 over a bolt 37.

At the end of shaft 8 (FIG. 3) leading out of casing 3 of sewing machine 2 is mounted a freely rotating handwheel 38 and held axially by means of a locking washer 39. Handwheel 38 is provided with a V-shaped groove 40 for a V-belt 41 which runs over a pulley 44 secured on shaft 42 of a positioning motor 43. An extension 45 is formed on handwheel 38 and is provided with a toothing for a toothed belt 46. Toothed belt 46 runs over a pulley 47 (FIG. 1) which is secured on the shaft 30 carrying eccentric 29.

A clutch 48 is provided for the driving connection of main shaft 8 of the sewing machine drive with handwheel 38 freely rotating on main shaft 8 and driven by positioning motor 43. Clutch 43 has an entrainer disc 49 clamped on main shaft 8 on which is movably mounted an adjusting ring 50. On adjusting ring 50 are secured several pins 51 extending parallel to main shaft 8, which are always engaged in corresponding bores 52 of the entrainer disc 49 in any switching position of adjust ring 50, and thus connect adjusting ring 50 nin-rotationally with entrainer disc 49. In extension 45 of handwheel 38 are provided a number of bores 53 corresponding to the number of bores 52. Bores 52 and 53 are aligned when eccentric 29 and main shaft 8 are in the corresponding phase position for the orderly operation of trimming device 1.

On pins 51 are secured compression springs 54 which bear on opposite end faces of entrainer disc 49 and of adjusting ring 50. Adjusting ring 50 is provided with an annular slot 55. On an extension 66 of casing 3 is mounted a two-arm lever 57. The lower arm of control lever 57 is forked and embraces the upper half of adjusting ring 50. At the two free ends of the forked part of control lever 57 is secured a pin 58 engaging annular slot 55. The upper arm of control lever 57 is connected with a single action compressed air cylinder 61 pivotally mounted on an extension 60 of casing 3.

Adjusting ring 50 carries on the front side facing casing 3 a friction coat 62. Clutch 48, the part of handwheel 38 designed as a pulley, and pulley 47 are covered by a hood 63.

EXAMPLE 2

Figure 4:
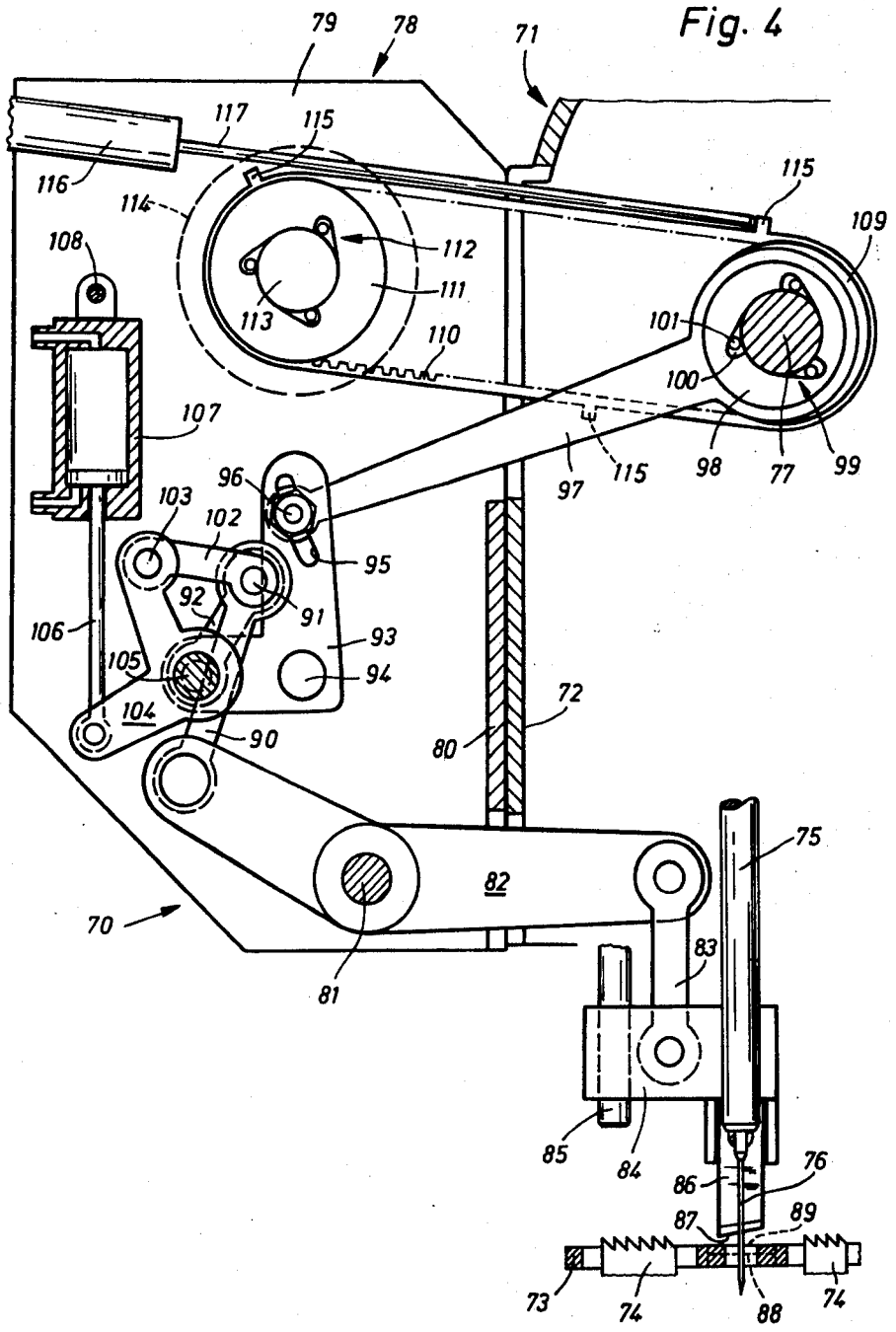
FIG. 4 is a view similar to FIG. 1 of another embodiment of the invention.

Trimming device 70 shown in FIG. 4 is arranged on a sewing machine 74 of which only the rear wall of casing 72, a stitch plate 73, a cloth feed 74, and a needle bar 75 with an inserted thread-carrying needle 76 are shown. Needle bar 75 is moved up and down by a main shaft 77 over a known gear (not shown) for the purpose of forming a seam, and enhance the feeding movement of cloth feed 74 driven in known manner it is moved swingingly about a horizontal axis extending parallel to main shaft 77.

Trimming device 70 has a frame 78 of two parallel side plates 79 and a connecting plate 80 which is secured on casing 72 of sewing machine 71. On a bolt 81 secured inside plates 79 is pivotally mounted a two-arm lever 82, at one end of which is arranged a guide rod 83. Guide rod 83 is articulated with a carrier 84 which is arranged for up and down movement on a guide bar 85 secured on casing 72 in a manner not shown here. On carrier 84 is secured a trimming knife 86 provided with a cutting edge 87. Associated with trimming knife 86 is a fixed counterknife 88 in a recess (not shown) of stitch plate 73, which has a cutting edge 89.

At the other end of lever 82 is arranged a guide rod 90 which is connected by a joint bolt 91 with another guide rod 92. Guide rod 92 is arranged at one end of an L-shaped swing lever 93 which is pivotally mounted in one of the side plates 79. In an oblong slot 95 provided at the other end of swing lever 93 is adjustably mounted a joint bolt 96 on which is secured an eccentric rod 57.

Eccentric rod 97 embraces an eccentric 98, which is arranged on main shaft 77 with the interposition of a freewheel clutch 99. Freewheel clutch 99 is designed as a clamping ratchet. It has on the inside of eccentric 98 three recesses 100, each of which has a radially and tangentially extending boundary surface. In each recess 100 is arranged a clamping roll 101. With main shaft 77 rotating clockwise, clamping rolls 101 clamp, after which the rotating movement of main shaft 77 is transmitted to eccentric 98.

On joint bolt 91 alsoacts a guide rod 102 which is arranged over a bolt 103 at one end of an L-shaped switching handle 104. Switching handle 104 is pivotally mounted on a bolt 105 which is secured in one of the side plates 79 of frame 78. The other end of switching handle 104 is connected with piston rod 106 of a piston of a compressed air cylinder 107, which is pivotally mounted over a bolt 108 on frame 78.

Eccentric 98 is connected rigidly with a pulley 109 for a toothed belt 110. Toothed belt 110 runs over a pulley 111 which is arranged, with the interposition of freewheel clutch 112, on shaft 113 of a geared engine 114 flanged on frame 78. Freewheel clutch 112 is designed like freewheel clutch 99 as a clamping ratchet and arrives likewise in clamping, and thus in entraining position with shaft 113 rotating clockwise. On toothed belt 110 are arranged three cam-shaped entraining elements 115 which are equally spaced from each other. This interval corresponds to the circumferential length of pulley 109. On frame 78 is also arranged a compressed air cylinder whoe stroke length corresponds to the mutual distance of two entraining elements 115. Compressed air cylinder 116 is so arranged that its piston rod 117 is directly above the upper strand of toothed belt 110.

The mode of operation is as follows:

EXAMPLE 1

For sewing, main shaft 8 of sewing machine 2 is connected with positioning motor 43 by engaging clutch 48. The engagement is effected by admitting compressed air cylinder 61 in such a way that control lever 57 is turned counter clockwise so that pins 51 engage bores 53 of extension 45 of the handwheel 38 and thus establish a non-rotary connection between handwheel 38 and main shaft 8 of sewing machine 2.

Positioning motor 43 drives handwheel 38 over a V-belt 41. The driving movement is transmitted from handwheel 38 over toothed belt 46 to pulley 47, and thus to shaft 30 carrying eccentric 29 and, with clutch 48 engaged, also to main shaft 8 of sewing machine 2.

The continuously driven eccentric 29 produces a swinging movement which is transmitted over eccentric bar 28 to swing lever 24, which consequently performs a swinging movement around bolt 25. When a workpiece edge is to be trimmed during sewing, compressed air cylinder 36 is brought into the position shown in FIG. 1. In this position guide rod 23 has been turned up so far that it assumes almost the same inclined position as guide rod 21. In this position of the two guide rods 21, 23, the swinging movement of swing lever 24 is transmitted over guide rods 23, 21 to lever 13, which moves carrier 15 with trimming knife 17 periodically up and down over guide rod 14.

In the position of eccentric 29 shown in FIG. 1, which is also called the backstroke position, trimming knife 17 is in the upper dead center of its up and down movement. The backstroke position of eccentric 29 coincides with the feeding phase of cloth feed 5 and needle 7, that is, trimming knife 17 is raised when needle 7 is lowered and is in the workpiece. In the position of eccentric 29 turned by 180°, which is also called the trimming position, swing lever 24 is turned clockwise and also lever 13 so that the trimming knife is in the lower dead center of its up and down movement and partly lowered into the recess of stitch plate 4 in which counterknife 19 is arranged.

When the seam is not to extend in the corner region of a workpiece in an angle corresponding to the contour of the workpiece, positioning motor 43 is stopped in a position in which needle 7 is in the lowered position. Compressed-air cylinder 61 is evacuated, after which compression springs 54 move adjusting ring 50 away from handwheel 38 in the direction of casing 3 of sewing machine 2, and press it with friction coat 62 on casing 3. By moving adjusting ring 50, pins 51 are removed from bores 53 of extension 45. This way clutch 48 is disengaged and the driving connection between positioning motor 43 and sewing machine 2 is interrupted.

The positioning motor 43 is again connected, after which trimming knife 17, with sewing machine 2 standing still, is driven in the above-described manner, that is, it is moved up and down continuously. With trimming knife 17 driven, the workpiece is turned about needle 7 acting as an axis of rotation, so that the edge of the workpiece is trimmed in the corner region and has in this position a uniform distance from the seam.

After turning the workpiece, positioning motor 43 is briefly stopped in the same position in which it had been stopped before when clutch 48 was disengaged. Since, with clutch 48 disengaged, main shaft 8 is stopped by the frictional bearing of adjusting ring 50 on casing 3, an angular movement is thus impossible, pins 51 and bores 53 again exactly oppose each other, after positioning motor 43 has been stopped again, so that sewing machine 2 can be put again in driving connection with positioning motor 43, admitting compressed air cylinder 61, and can thus continue to sew. With a corresponding design of clutch 48, sewing machine 2 could also be connected again with positioning motor 43, with the latter running.

If the edges are not to be trimmed during sewing, trimming device 1 is disconnected by turning switching handle 33 so far clockwise, by corresponding admission of compressed-air cylinder 36, that joint bolt 22 is aligned with belt 25. This has the result that trimming knife 27 is raised into a rest position which is relatively far from stitch plate 4 and that the swinging movement transmitted by eccentric 29 to swing lever 24 is no longer transmitted to guide rod 21. Trimming knife 27 stands therefore absolutely still in rest position, despite the driven swing lever 24.

EXAMPLE 2

Sewing machine 71 is driven over a positioning motor (not shown) which is in continuous driving connection with main shaft 77. With sewing machine 71 running, main shaft 77 turns clockwise. In this direction of rotation, clamping rolls 101 clamp, after which freewheel clutch 99 is in entraining position. This way the driving movement of main shaft 77 is transmitted to eccentric 98 and pulley 109 connected with it. Eccentric 98 generates a swinging movement which is transmitted over eccentric rod 97 to swing lever 93, which consequently performs a swinging movement about bolt 94. The rotary movement of pulley 109 is transmitted over toothed bolt 110 to pulley 111, with pulley 111 rotating clockwise and shaft 113 of geared engine 114 standing still, freewheel clutch 112 is in freewheeling position, so that geared engine 114 offers no resistance to the entraining movement of pulley 111.

For trimming a workpiece during sewing, compressed air cylinder 107 is in the position shown in FIG. 4. In this position, guide rod 92 is turned up so far that it assumes practically the same inclined position as guide rod 90. In this position of the two guide rods 90, 92, the swining movement of swing lever 93 is transmitted to lever 82, which moves the carrier 84 over guide rod 83 periodically up and down with trimming knife 86.

In the position of eccentric 98 shown in FIG. 4, which is also called the backstroke position, trimming knife 86 in the upper dead center of its up and down movement. The backstroke position of eccentric 98 coincides with the feeding phase of cloth feed 74 and needle 76, that is, trimming knife 86 is raised when needle 76 is lowered and is in the workpiece. In the position of eccentric 98 turned by 180°, which is also called the trimming position, swing lever 93 and over guide rods 92, 90, also lever 82 are turned clockwise, so that trimming knife 86 is in the lower dead center of its up and down movement and is partly lowered into the recess (not shown) of stitch plate 73 in which counterknife 88 is arranged.

If the same is to extend angularly in a corner region of a workpiece corresponding to the contour of the workpiece, sewing machine 71 is stopped with needle 76 lowered, after which the workpiece is turned about needle 76 serving as an axis of rotation. To make sure that the edge of the workpiece has a uniform distance from the seam, even in the corner region, trimming knife 86 is moved up and down during the rotation of the workpiece with sewing machine 71 standing still. To this end, geared engine 114 is started, whose shaft 113 rotates clockwise. In this direction of rotation of shaft 113, freewheel clutch 112 is in its entraining position, so that the driving movement of shaft 113 is transmitted to pulley 111, and from the latter by means of toothed belt 110, pulley 109 and eccentric 98. With eccentric 98 driven clockwise and main shaft 77 stopped, freewheel clutch 99 is in its freewheeling position, so that main shaft 77 does not offer any resistance to the driving movement generated by geared engine 114. Eccentric 98, which is now continuously driven by geared engine 114, generates now a periodic up and down movement of trimming knife 86, just as with sewing machine 71 running.

After the workpiece no longer turns, geared engine 114 is first disconnected. Since eccentric 98 is stopped here in a position which can not be predetermined, a proper phase alignment of eccentric 98 by a synchronization with main shaft 77 is necessary in case eccentric 98 is not accidentally in the proper phase position to main shaft 77. The alignment or synchronization is effected by admitting compressed air cylinder 116, whose piston rod 117 is then moved along directly above toothed belt 110. If there is an entraining element 115 in the path of motion of piston rod 117, toothed belt 110 is entrained and both freewheel clutches 99, 12 are in freewheeling position. Compressed air cylinder 116 is so arranged that toothed belt 110 is turned so far in the end position of piston rod 117 that eccentric 98 is in any case in the proper phase position to main shaft 77, independent of which of the three entraining elements 115 have been entrained by piston rod 117.

After eccentric 98 has been aligned, sewing machine 71 is started again, after which eccentric 98 is driven again over main shaft 77, with geared engine 114 disconnected.

When the sewing speed in the sewing of narrow arcs and thus the one trimming frequency corresponding to speed of rotation of eccentric 98 becomes less than the trimming frequency that can be achieved by geared engine 114, the trimming frequency can be increased relative to the movement of needle bar 75 by starting geared engine 114 with sewing machine 71 running. In this case, eccentric 98 is driven, as with sewing machine 71 standing still, ver toothed belt 119 with freewheel clutch 99 is freewheeling position, and the slower driven main shaft 77 is taken over. Since the phase position of eccentric 98 is changed again in this case, eccentric 98 must be arranged again in the proper phase position in the above described manner when geared engine 114 is shut off.

If no edges are to be trimmed during sewing, trimming device 70 is disconnected by turning switching handle 104 so far clockwise by corresponding admission of compressed air cylinder 107 that joint bolt 91 is aligned with bolt 94. This has the result that trimming knife 86 is raised into a rest position which is relatively far away from stitch plate 73, and that the swinging movement transmitted by eccentric 98 to swing lever 93 is no longer transmitted to guide rod 90. Trimming knife 86 therefore stands absolutely still in rest position despite the driven swing lever 93.

While specific embodiments of the invention have been shown and described to illustrate the application of the principles of the invention, it will be understood that the invention may be embodied otherwise without departing from such principles.

What is claimed is:

1. A sewing machine comprising a rotatable main shaft, a sewing station over which material to be sewn is moved, a needle driven by said main shaft to move upwardly and downwardly through the material, a trimming knife mounted adjacent said needle for upward and downward movement adjacent said needle to periodically and selectively cut the material, a connecting mechanism connected to said knife to move it upwardly and downwardly, and a detachable drive connected to said connecting mechanism and connectable to said main shaft and permitting drive of said knife with said main shaft and drive of said knife independent of said main shaft, said detachable drive including an eccentric which is rotatable to drive said connecting mechanism.

2. A sewing machine according to claim 1, wherein said detachable drive includes a positioning motor in driving connection with said eccentric and clutch means connecting said positioning motor to said main shaft.

3. A sewing machine according to claim 1, including a free wheel clutch on said main shaft, a motor having a second rotatable shaft, a second free wheel clutch on said second rotatable shaft and belt means interconnecting said first and second freely rotatable clutches, said second shaft being separately drivable to move said knife independently of the main shaft.

4. A sewing machine according to claim 3, wherein the driving connection between said freewheel clutches includes an entraining element arranged at spaced locations along the driving connection and an adjusting device engageable with the entraining elements to effect adjustment of said drive.

5. A sewing machine according to claim 2, including a driving wheel rotatably mounted on said shaft, said motor being connected to said driving wheel to rotate said wheel, said clutch means disposed between said wheel and said shaft for rotating said shaft, said wheel including a pulley, and a belt engaged between said pulley and said wheel for driving said eccentric from said wheel.

6. A sewing machine according to claim 5, wherein said clutch means includes a coupling element co-rotatably mounted on said main shaft and axially displaceable thereon into engagement with said driving wheel to drive said shaft, said coupling element being movable in an opposite position and including a surface disposed in the path of movement of said element in an opposite position, to engage said frame and to brake said shaft.

7. A sewing machine according to claim 1, including bottom feed means for feeding material on said sewing station and top needle feed means associated with said needle for feeding material on said sewing station.

8. A sewing machine comprising a sewing machine frame, a main shaft journalled in said frame for rotation therein, a hand wheel rotatably mounted on said main shaft and having a drive pulley thereon, an eccentric shaft having a drive pulley, belt means interconnecting said eccentric shaft drive pulley and said main shaft drive pulley, a sewing needle mounted on said sewing machine frame for upward and downward movement, a trimming knife mounted alongside said needle for upward and downward movement and connected to said eccentric drive for moving said trimming knife upwardly and downwardly, clutch means between said hand wheel and said main shaft for selectively coupling said hand wheel to said main shaft, a positioning motor connected to said hand wheel to rotate said hand wheel selectively with said main shaft and without said main shaft depending upon the engagement and disengagement of said clutch means to drive said trimming knife.

9. A sewing machine according to claim 8, wherein said clutch means includes an axially shiftable part surrounding said main shaft and means for shifting said movable part to effect selectively clutching and braking.

10. A sewing machine according to claim 8, wherein the connection between said eccentric and said knife includes a linkage mechanism and an air cylinder having a piston slidable thereon connected to said mechanism for adjusting said mechanism for varying the movement of said knife.

* * * * *